US006781503B1

(12) United States Patent
Kubota

(10) Patent No.: US 6,781,503 B1
(45) Date of Patent: Aug. 24, 2004

(54) FUSE ASSEMBLY FOR DIFFERENTLY STRUCTURED FUSES

(75) Inventor: Katsuhiro Kubota, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/421,870

(22) Filed: Apr. 24, 2003

(51) Int. Cl.[7] ..... H01H 85/20; H01H 85/22
(52) U.S. Cl. ..... 337/230; 337/198; 337/284
(58) Field of Search ..... 337/186–188, 337/208, 209, 229, 283, 284, 230, 289, 197, 198, 211; 29/623

(56) References Cited

U.S. PATENT DOCUMENTS 2,186,813 A * 1/1940 Frederick et al. ..... 337/210
4,391,485 A * 7/1983 Urani ..... 439/687
4,559,504 A * 12/1985 Krec ..... 337/194
5,055,071 A * 10/1991 Carlson et al. ..... 439/621
5,616,054 A * 4/1997 Quinlan ..... 439/621
5,668,521 A * 9/1997 Oh ..... 337/186
5,841,337 A * 11/1998 Douglass ..... 337/198
5,841,338 A * 11/1998 Yasukuni ..... 337/293
5,945,903 A * 8/1999 Reddy et al. ..... 337/197
5,969,587 A * 10/1999 Combas ..... 335/132
5,973,418 A * 10/1999 Ciesielka et al. ..... 307/130
6,359,543 B2 * 3/2002 Endo et al. ..... 337/198
6,407,657 B1 * 6/2002 Oh ..... 337/197
6,496,096 B2 * 12/2002 Kondo et al. ..... 337/234
6,522,234 B1 * 2/2003 Sturgill ..... 337/198
6,531,948 B1 * 3/2003 Mennell ..... 337/211
6,545,585 B2 * 4/2003 Endo et al. ..... 337/260
6,556,120 B2 * 4/2003 Endo et al. ..... 337/198
2002/0044038 A1 * 4/2002 Andoh et al. ..... 337/260
2003/0201866 A1 * 10/2003 Sudan et al. ..... 337/188
2003/0201867 A1 * 10/2003 Sudan et al. ..... 337/216

* cited by examiner

*Primary Examiner*—Anatoly Vortman
(74) *Attorney, Agent, or Firm*—Finnegan, Henderson, Farabow, Garrett & Dunner, L.L.P.

(57) ABSTRACT

The fuse assembly includes a first fuse. The first fuse includes a first housing. The first fuse includes a pair of first terminals having a first pitch between the first terminals and projecting from the first housing in a mounting direction. The assembly Includes a second fuse. The second fuse includes a second housing. The second fuse includes a pair of second terminals having a second pitch between second terminals identical to the first pitch and provided on both sides of the second housing. The assembly includes a mounting component mated with the first fuse or the second fuse. The mounting component includes mating terminals within the mounting component for electrically conducting with the first terminals or second terminals. The mounting component includes a first stopper configured to position the first fuse relative to the mounting component for electrically connecting the first terminals and the mating terminals with each other. The mounting component includes a second stopper configured to position the second fuse relative to the mounting component for electrically connecting the second terminals and the mating terminals with each other.

8 Claims, 13 Drawing Sheets

FUSE ASSEMBLY FOR DIFFERENTLY STRUCTURED FUSES

BACKGROUND OF THE INVENTION

The present invention relates to a fuse assembly adapted to a connection box. Specifically, the fuse assembly allows differently structured fuses to be arbitrarily mounted.

Conventionally, different fuses require mounting components in accordance with the structures of the fuses, respectively. Thus, it is necessary to produce a connection box with respective mounting components in accordance with the structures of corresponding fuses.

SUMMARY OF THE INVENTION

The invention is directed to a fuse assembly with interchangeability, which allows arbitrary mounting of differently structured fuses.

The invention is also directed to a fuse assembly, which enhances the method of placing a fuse into operating position.

The first aspect of the invention provides a fuse assembly The assembly includes a first fuse. The first fuse includes a first housing. The first fuse includes a pair of first terminals having a first pitch between first terminals and projecting from the first housing in a mounting direction.

The assembly includes a second fuse. The second fuse includes a second housing. The second fuse includes a pair of second terminals having a second pitch between second terminals identical to the first pitch and provided on both sides of the second housing.

The assembly includes a mounting component mated with the first fuse or the second fuse. The mounting component includes mating terminals within the mounting component for electrically conducting with the first terminals or second terminals. The mounting component includes a first stopper configured to position the first fuse relative to the mounting component, for electrically connecting the first terminals and the mating terminals with each other. The mounting component includes a second stopper configured to position the second fuse relative to the mounting component for electrically connecting the second terminals and the mating terminals with each other.

Preferably, the first stopper is positioned in front of ends of the mating terminals. The second stopper is positioned back from the ends of the mating terminals.

Preferably, the first housing includes a pair of first tapers. The mounting component includes inner walls opposite to each other. The first stopper includes a pair of stopper members with upper ends having a pair of second tapers. The pair of second tapers is configured to abut against the pair of first tapers.

Preferably, the second stopper includes a bottom wall within the mounting component for abutting a lower end of the second housing against the bottom wall.

The second aspect of the invention provides a fuse assembly. The assembly includes a first fuse. The first fuse includes a first housing. The first fuse includes a first terminal projecting from the first housing.

The assembly includes a second fuse, the second fuse includes a second housing. The second fuse includes a second terminal flush with the second housing or positioned back from the second housing.

The assembly includes a mounting component configured to mate with the first fuse or the second fuse. The mounting component includes a mating terminal for electrically conducting with the first terminal or the second terminal.

The assembly includes a positioning mechanism for positioning the first fuse or the second fuse to the mounting component. The mechanism includes a first stopper mounted to the mounting component for abutting against the first housing, thus allowing electrical conduction between the first terminal and the mating terminal. The mechanism includes a second stopper mounted to the mounting component for abutting against the second housing, thus allowing electrical conduction between the second terminal and the mating terminal.

Preferably, the first stopper extends beyond the mating terminal.

Preferably, the second stopper is positioned back from the mating terminal.

Preferably, the first stopper includes a taper for engaging with the first housing.

BRIEF DESCRIPTION OF THE ACCOMPANYING DRAWINGS

DETAILED DESCRIPTION OF THE PREFERRED EMBODIMENTS

A fuse-assembly with the structure of a fuse-mounting component according to an embodiment of the present invention will hereby be described with reference to the drawings. The mounting component 20 is mounted with first fuse 50 or second fuse 10.

Figure 2A:
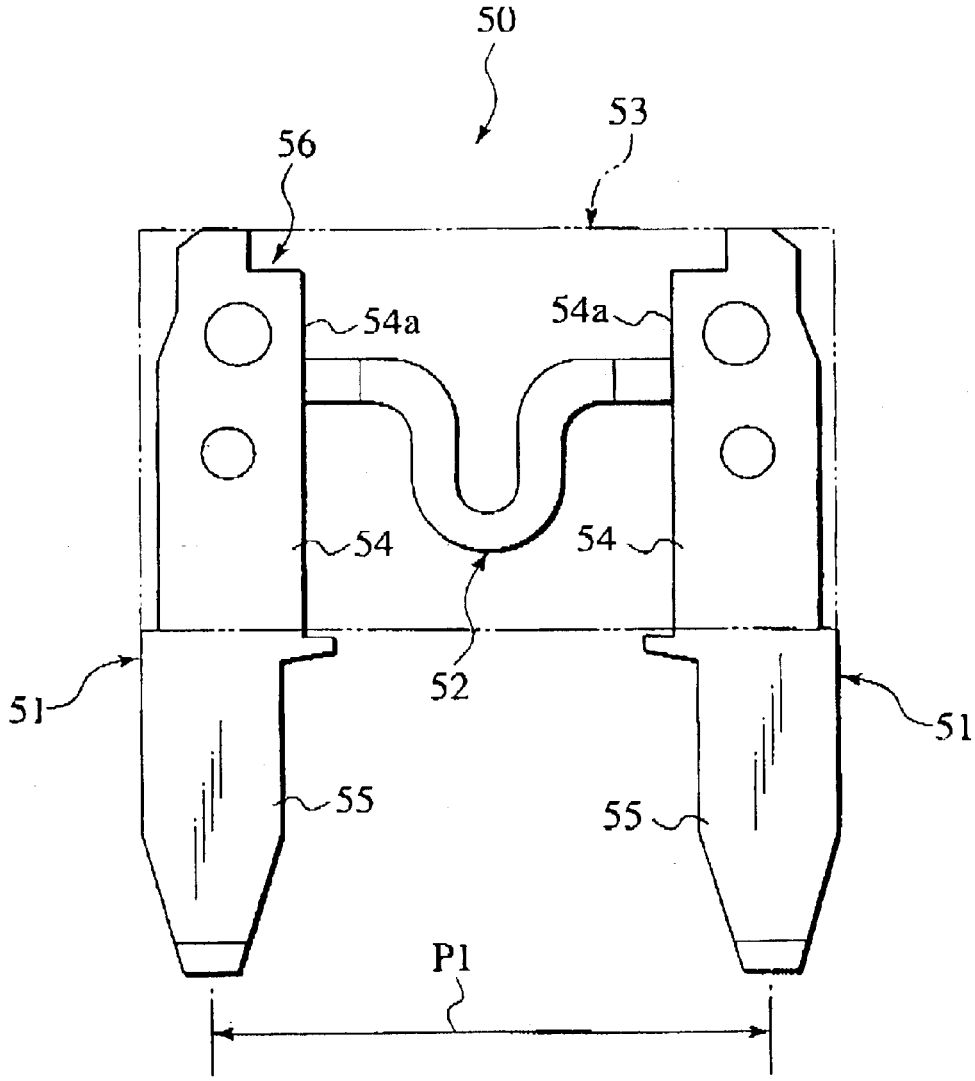
FIG. 2A is an elevation view illustrating the first fuse in FIG. 1.

In FIG. 2A, first fuse 50 is a blade-type fuse. Fuse 50 includes fuse-element 56. Fuse-element 56 includes a pair of parallel metallic plane-plate terminal 51 (referred to as a plane terminal). Fuse-element 56 includes fusible part 52 between terminals 51. Fuse-element 56 has a proximal end (an end provided to fusible part 52), which is received in insulative housing 53.

Figure 1:
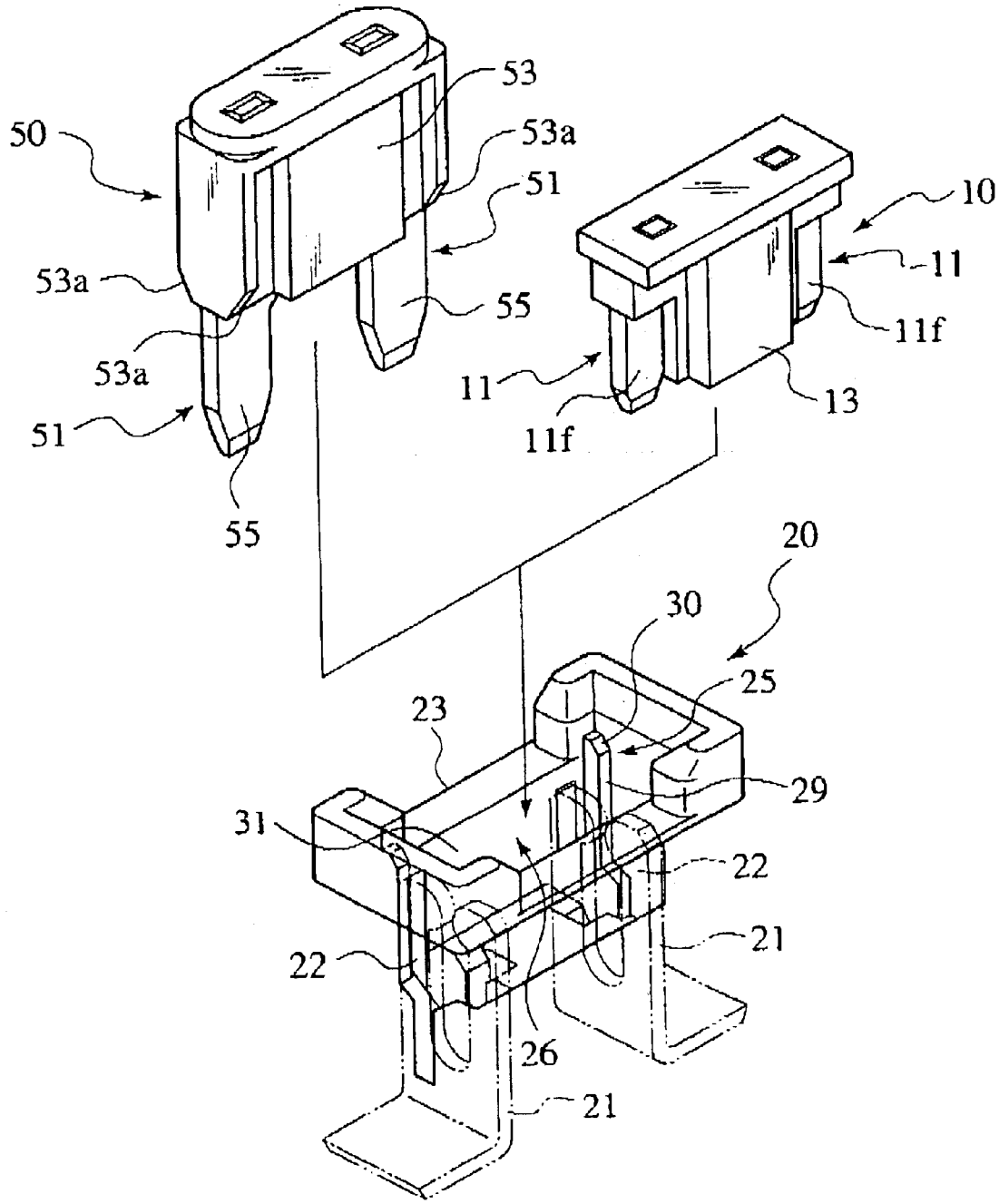
FIG. 1 is a perspective view illustrating a fuse-mounting component and the first and second fuses of a fuse assembly according to the embodiment of the invention, fuses being mounted to the fuse-mounting component.

Terminals 51 include primary terminals 54 which are received in housing 53, respectively. Terminals 51 include tab-terminals 55 which greatly protrude from housing 53 outwardly (downward in FIG. 2A) in a mounting direction. Fusible part 52 with a predetermined sectional area lies between inner edges 54*a* of terminals 51 opposite to each other. Housing 53 includes tapers 53*a* at the lower edges on both the front and rear sides of both the left and right ends, as shown in FIG. 1. Tapers 53*a* are directed outside of housing 53.

Figure 2B:
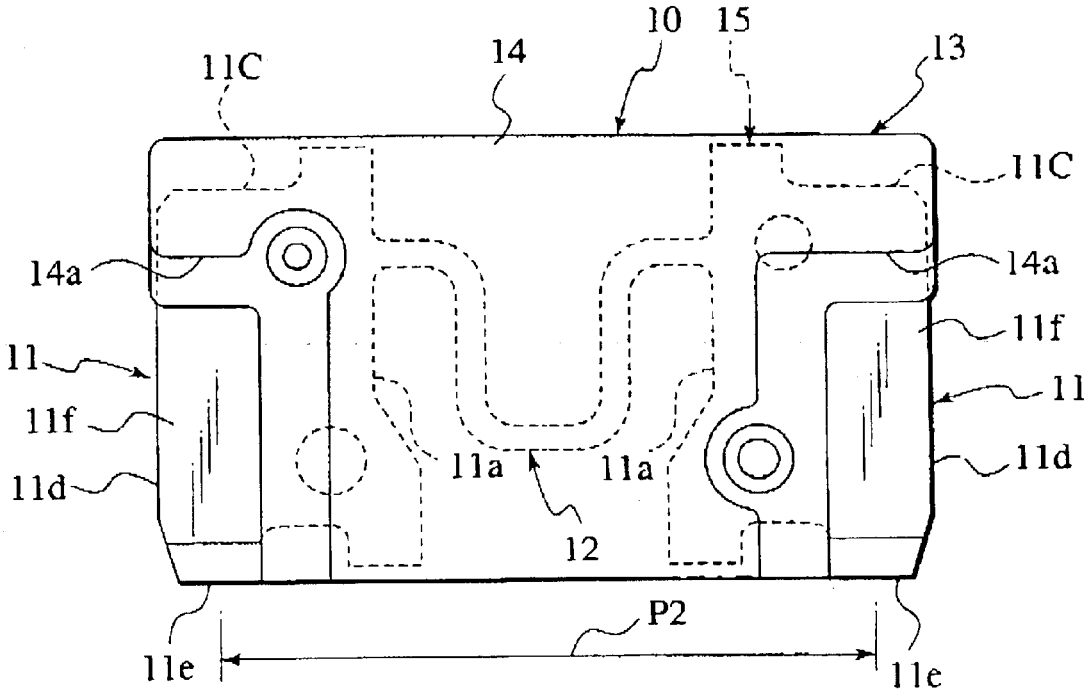
FIG. 2B is an elevation view illustrating the second fuse.

In FIG. 2B, second fuse 10 is a blade-type fuse. Fuse includes fuse-element 15. Fuse-element 15 includes a pair of terminals 11. Fuse-element 15 Includes, a fusible part 12 between terminal 11. Fuse-element 15 is received in insulative housing 13.

Terminals 11 in a substantially rectangular shape include inner edges 11*a*, between which fusible part 12 with a predetermined sectional area lies.

Housing 13 includes a pair of housing members 14 in a substantially T-shape. The fuse-element 15 is interposed between housing members 14 in a width direction, which Integrally joins housing members 14 with fuse-element 15. Housing members 14 and fuse-element 15 are welded and fixed each other.

Thus, housing 13 covers fusible part 12 and inner edges 11*a* and upper edges 11*c*. Housing 13 covers fuse-elements 15, except for the right and reverse sides from respective outer edges 11*d* and lower ends 11*e* of terminals 11 to intermediate portions 11*f* positioned on the sides of fusible part 12. Terminals 11 are arranged on the left and right sides of housing 13. The outer edges 11*d*, lower ends 11*e*, and intermediate portions 11*f* are exposed from housing 13. Lower ends 11*e* are flush with the outer most wall of housing 13 in a mounting direction, but may be positioned back from the outermost wall of housing 13.

Respective intermediate portions 11*f* of terminals 11 are crimped and fixed by mating terminals 21, thus electrically connecting with mating terminals 21.

A pitch P2 between respective intermediate portions 11*f*of terminals 11 is identical in length to a pitch P1 between terminals 55 of fuse 50.

Housing 13 has portions with fixture-engaging steps 14*a*, the portions covering upper edges 11*c* of terminals 11, respectively. Steps 14*a* engage with a fuse-removing fixture (not illustrated), when fuse 10 is removed from mounting component 20.

Fuse 10 does not include a tab-terminal greatly protruding outside from housing 13, unlike terminals 55 in fuse 50. Fuse itself is structured in a rectangular shape from the front view.

Fuse-mounting component 20, as shown in FIGS. 1, 2*c*, 3, and 4, includes fuse-insertion part 23, into which first fuse 50 (as shown in FIG. 2A) is inserted and fitted, fuse 50 including a pair of terminals 55 protruding from housing 53 in a mounting direction. Insertion part 23 includes a recess defined by opposite front and rear side walls 24*a*, opposite left and right side walls 24*b*, and bottom wall 31. Mounting component 20 includes mating terminals 21 within insertion part 23, which are connected to terminals 55. Mating terminals 21 protrude vertically through bottom wall 31 into insertion part 23. The longitudinal ends of the mating terminals 21 are positioned vertically in front of bottom wall 31. Mounting component 20 includes first stoppers 25 at the four corners within insertion part 23, which restricts first fuse 50 at the insertion position. First stoppers 25 extend vertically beyond the longitudinal ends of mating terminals 21. Mounting component 20 includes hood 24 for inserting and fitting housing 53 thereinto.

Mounting component 20 includes second stopper 26 which includes bottom wall 31. Second stopper 26 restricts second fuse 10 (a small-sized fuse as shown in FIG. 2B) to be inserted into insertion part 23 at the insertion position. Second stopper 26 allows terminals 11 to be connected to mating terminals 21. Second fuse 10 is provided with a pair of terminals 11 on both sides of housing 13. The pitch P2 between terminals 11 is identical in dimension to the pitch P1 between the pair of terminals 55.

Figure 3:
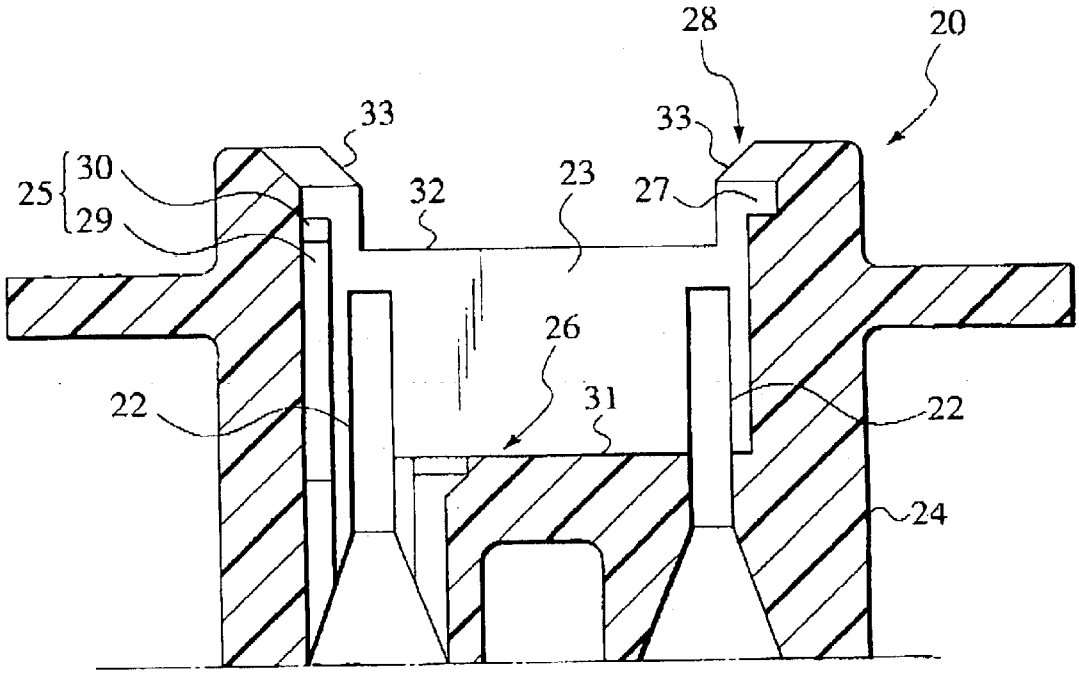
FIG. 3 is a section view along the III—III line in FIG. 2C.
Figure 4:
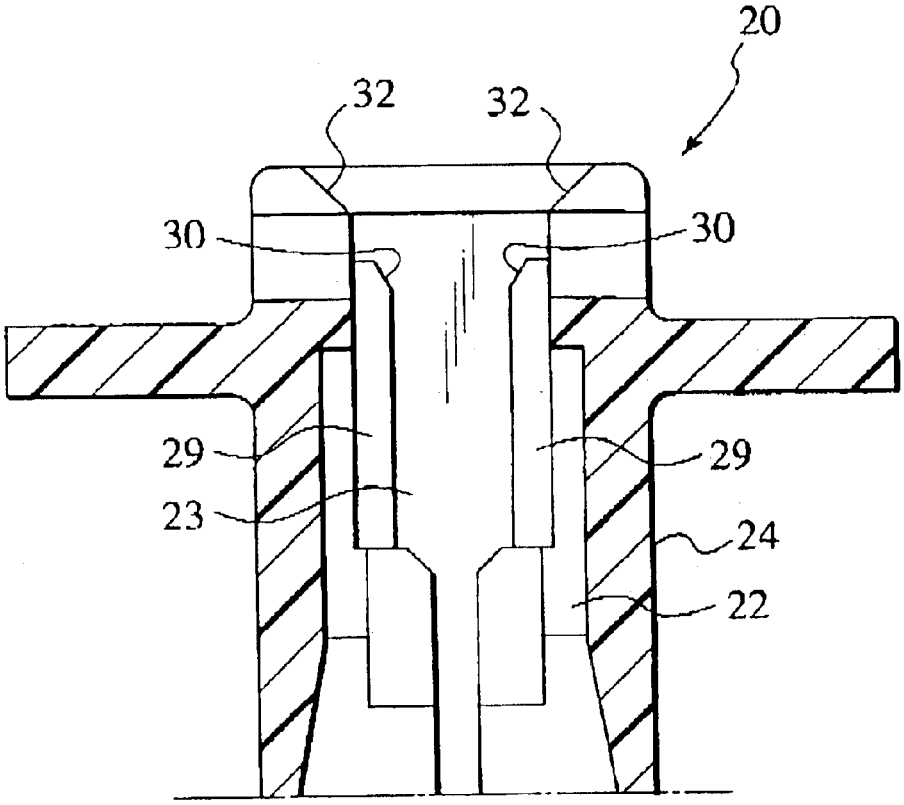
FIG. 4 is a sectional view along the IV—IV line in FIG. 2C.
Figure 5:
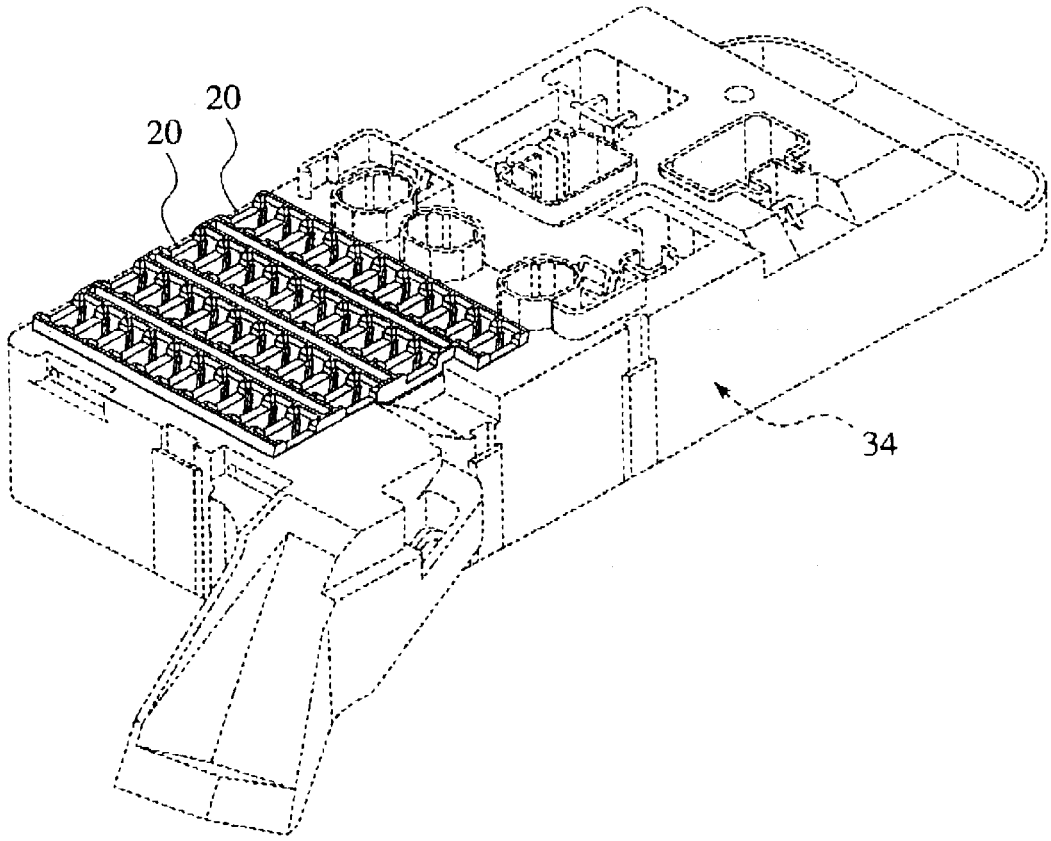
FIG. 5 is a perspective view illustrating an example wherein the mounting component in FIG. 1 is mounted on a connection box.

In FIG. 3, hood 24 includes a cutout 27 for removing a fixture at the upper end, into or from which a fuse-removing fixture is inserted or removed. Hood 24 includes insertion-guide 28 at the upper end. Guide 28 guides housing 53 of first fuse 50 or housing 13 of second fuse 10 to be inserted, when the fuse 10 or 20 is inserted and fitted into insertion part 23.

Figure 2C:
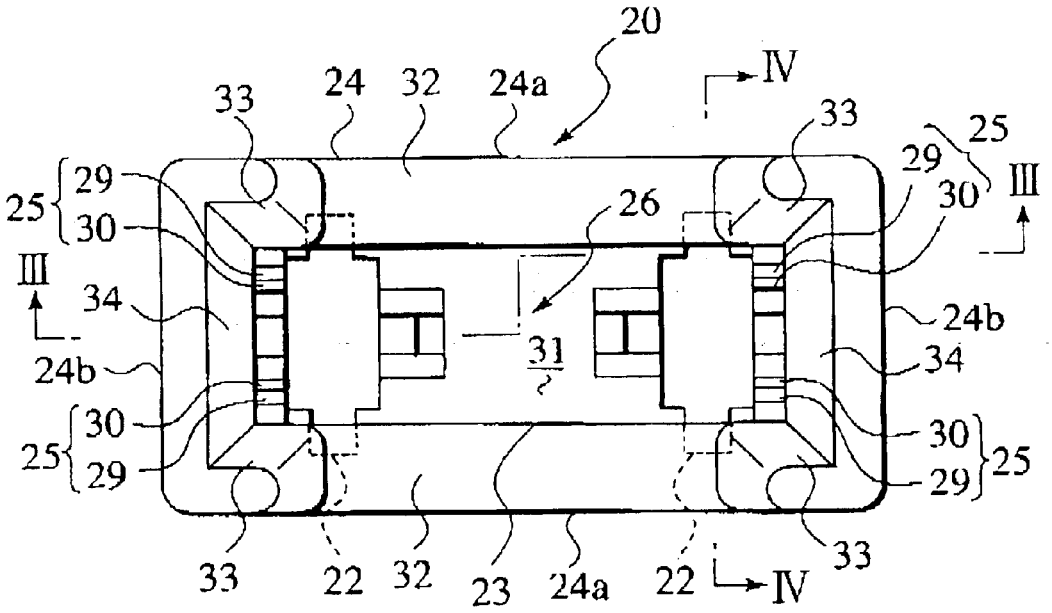
FIG. 2C is a plane view illustrating the structure of a mounting component in FIG. 1.

In FIG. 2C, first stopper 25 includes a pair of stopper members 29 integrally on the inner surfaces of opposite left and right walls 24*b* of hood 24, respectively. Stopper members 29 have upper ends formed with a pair of tapers 30 directed inside each other.

The abutting of tapers 53*a* of first fuse 50 against a pair of tapers 30 restricts first fuse 50 relative to mounting component 20 in insertion position.

Second stopper 26 includes bottom wall 31 provided to the lower end of insertion part 23 in hood 24.

The abutting of the lower end of housing 13 of second fuse against the upper end of bottom wall 31 restricts second fuse relative to mounting component 20 in insertion position.

Guide 28 includes both end steps of recess 32, where respective upper parts of opposite front and rear walls 24*a* of hood 24 are cut out. Guide 28 includes inclined faces 33 and 34 directed inside, which are formed between upper edges of front and rear walls 24*a* and between the upper edges of left and right walls 24*b*.

Cutouts 27 are formed with the upper ends of left and right walls 24*a*.

Mounting component 20 is integrally formed with the top side of connection box 34.

Figure 6:
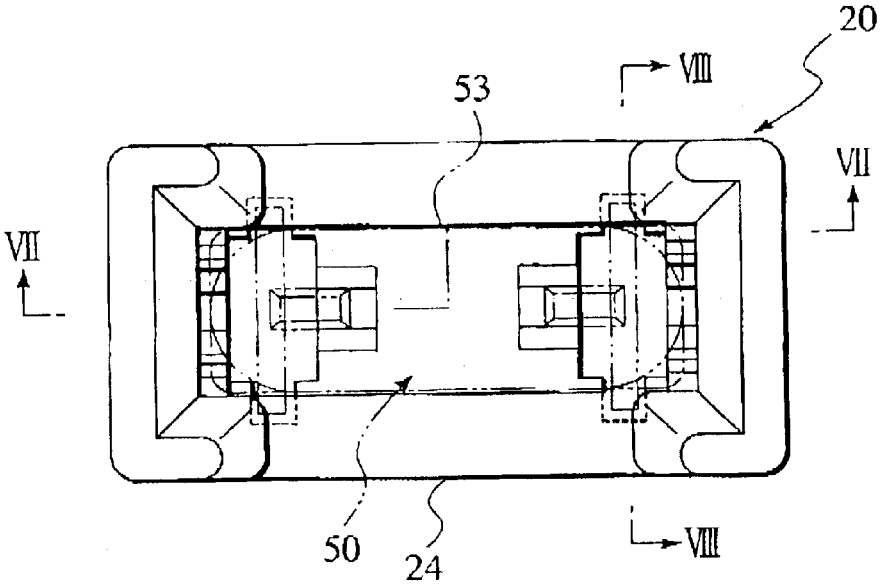
FIG. 6 is a plane view illustrating an assembly wherein the first fuse is mounted to the mounting component in FIG. 1.
Figure 7:
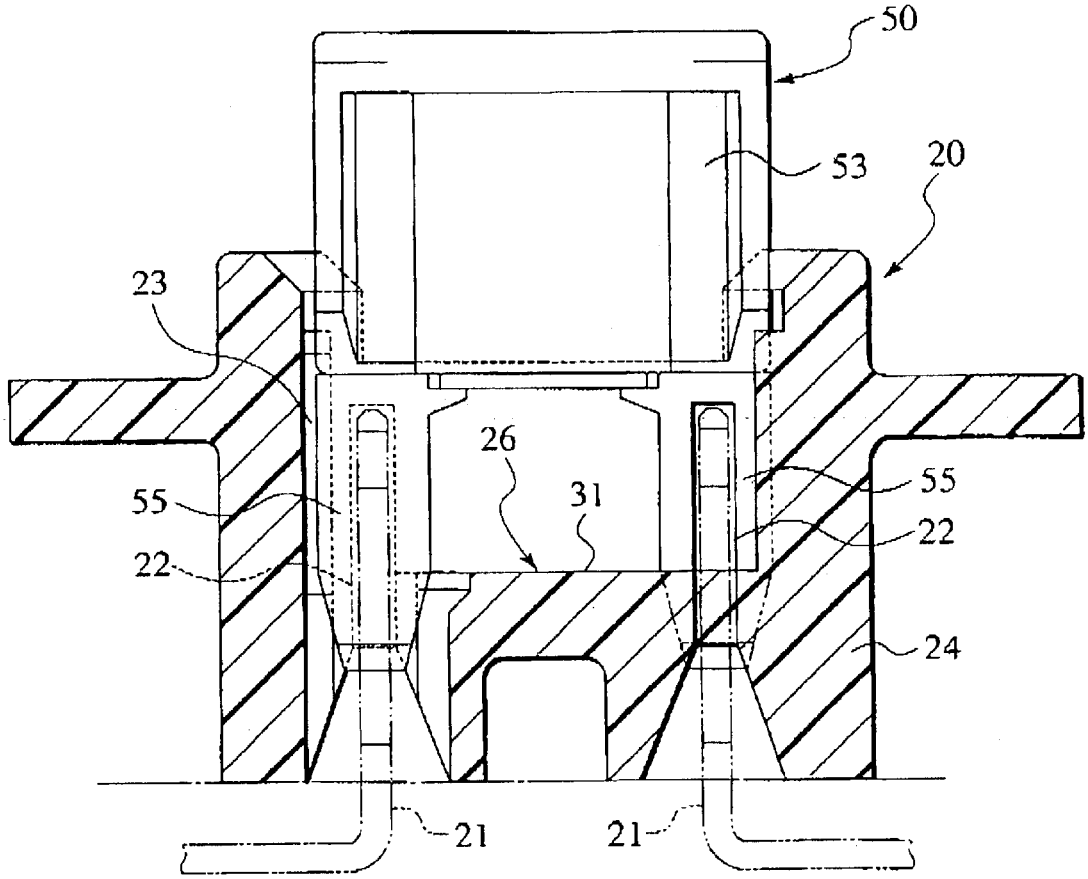
FIG. 7 is a section view along the VII—VII line in FIG. 6.
Figure 8:
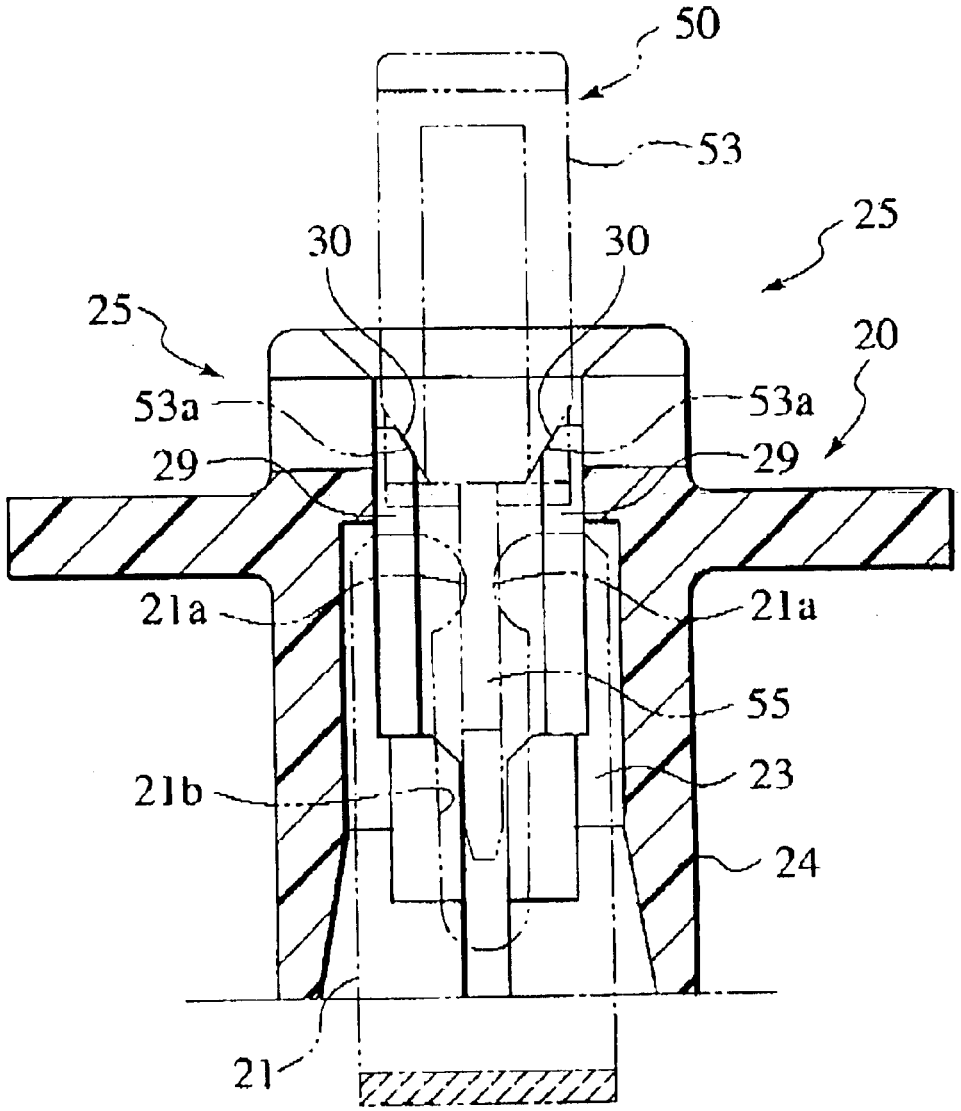
FIG. 8 is a section view along the VIII—VIII line in FIG. 6.

In FIGS. 6 to 8, first fuse 50 in FIG. 2A is mounted to mounting component 20.

Tapers 53*a* at the lower edges of housing 53 abut against tapers 30 as first stoppers 25 of mounting component 20. The abutting allows first fuse 50 to be mounted to mounting component 20. The crimping and fixing of terminals 55 by mating terminals 21 of mounting component 20 allows the electrical connection of terminals 55 with mating terminals 21.

Mating terminals 21, as shown in FIG. 8, have terminal pieces formed with for example, the ends of bus-bars. Terminals 21 with U-shaped slots 21*b* include the terminal pieces with separated ends, which are cut at the ends in a longitudinal direction. The terminal pieces have a pair of crimping portions 21*a* at the upper ends, which bulge inside each other. Crimping portions 21*a* serve as a connecting terminal in a tuning-fork shape.

The first stoppers 25 of mounting component 20 are positioned at the upper portion of hood 24. The first stoppers are positioned above the mating terminals 21. This positioning allows terminals 55 of first fuse 50 to be crimped and fixed by mating terminals 21.

Figure 9:
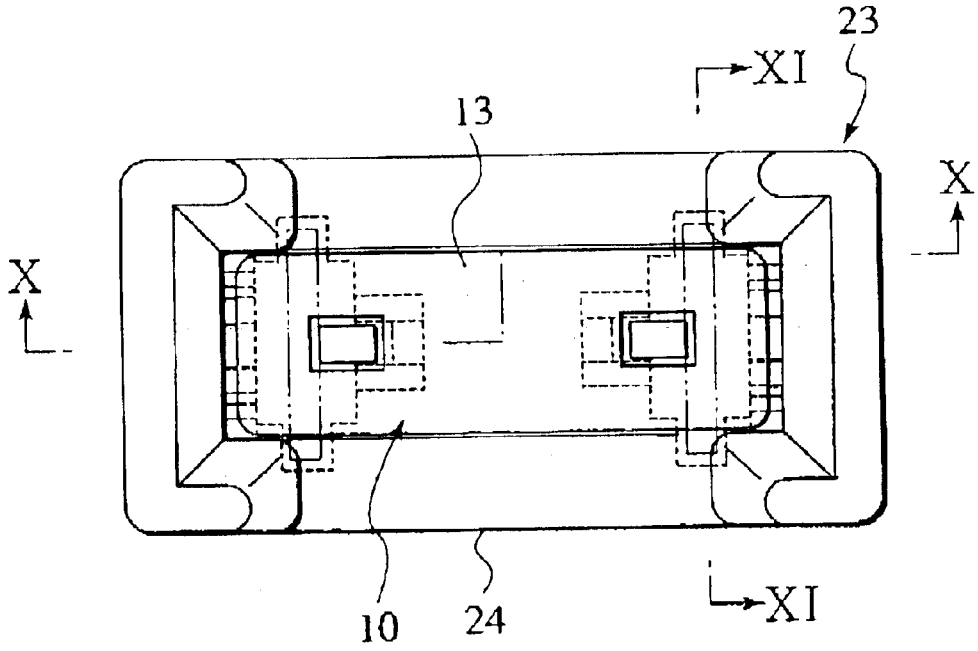
FIG. 9 is a plane view illustrating an assembly wherein the second fuse is mounted to the mounting component in FIG. 1.
Figure 10:
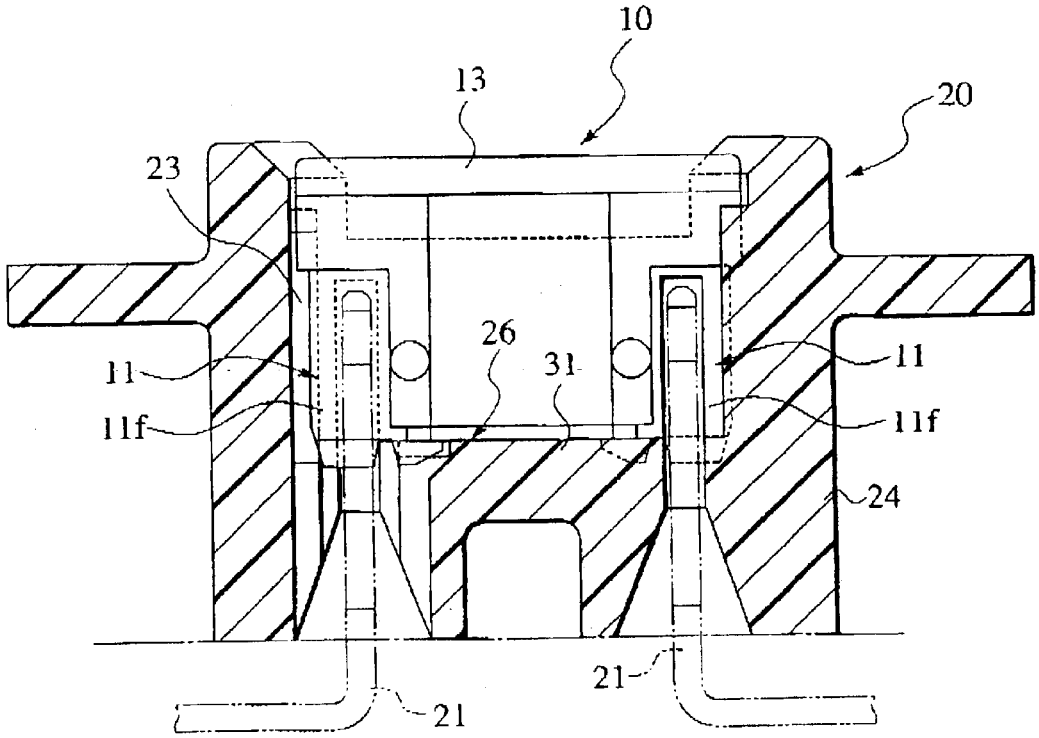
FIG. 10 is a section view along the X—X line in FIG. 9.
Figure 11:
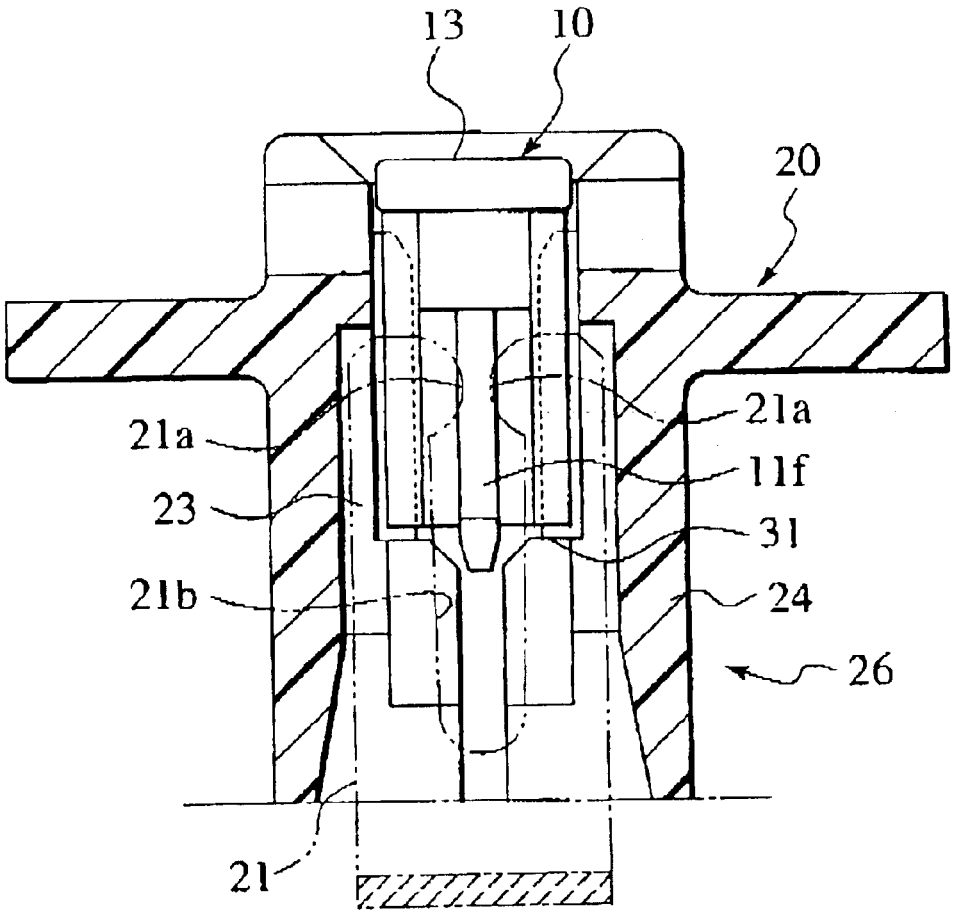
FIG. 11 is a section view along the XI—XI line in FIG. 9.

In FIGS. 9 to 11, second fuse 10 in FIG. 2B is mounted to mounting component 20.

The lower edge of housing 13 abuts against the upper ends of bottom wall 31 as second stopper 26, which allows second fuse to be mounted to mounting component 20. Mating terminals 21 crimp and fix intermediate portions 11*f* of terminals 11 for electrical connection.

The second stopper 26 of mounting component 20 is positioned at the lower portion of hood 24. Second stopper 26 is positioned below mating terminals 21. This positioning allows intermediate portions 11*f* to be crimped and fixed by mating terminals 21. Second fuse 10, mounted to mounting component 20, is embedded within insertion part 23.

According to mounting component 20, as shown in FIG. 1, the first stopper 25, positioned at the upper position of insertion part 23, restricts the first fuse at the insertion position. The second stopper 26, positioned at the lower position of insertion part 23, restricts second fuse 10 at the insertion position. This allows first and second fuses 50 to be arbitrarily mounted with interchangeability.

Mounting component 20 lowers in overall height, unlike a conventional fuse-mounting component, thus enhancing the method of inserting fuse 10 or 50 in workability.

The entire contents of Japanese Patent Applications P2000-312085 (filed on Oct. 12, 2000) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

According to the fuse assembly, when mounting a first fuse, a first stopper restricts the first fuse relative to a mounting component in insertion position, which allows the first terminals to be connected to mating terminals. When mounting a second fuse, a second stopper restricts the second fuse relative to the mounting component in insertion position, which allows the second terminals to be connected to the mating terminals.

Thus, the assembly allows the first and second fuses different from each other in structure to be arbitrarily mounted, with interchangeability.

The mounting component lowers in overall height, unlike a conventional fuse-mounting component, thus enhancing the method of inserting the first or second fuse in workability.

When mounting the first fuse, the first stopper in front of the mating terminals restricts the first fuse relative to the mounting component in insertion position. This allows the mating terminals to crimp and fix the pair of first terminals therebetween. When mounting the second fuse, the second stopper at back of the mating terminals restricts the second fuse relative to the mounting component in insertion position. This allows the pair of second terminals and the mating terminals to be connected each other.

Thus, the mounting component supports the first or second fuse in a balanced manner.

When mounting the first fuse, the abutting of the first tapers of the first housing against the second tapers of the first stopper, allows the engaging of the lower end of the first housing and the upper end of the first stopper with each other. This securely restricts the first fuse relative to the mounting component in insertion position.

Thus, the mounting component further supports the first fuse in d balanced manner.

When mounting the second fuse, the lower end of the second housing abuts against the bottom wall within the mounting component. This securely restricts the second fuse relative to the mounting component in Insertion position.

Thus, the mounting component further supports the second fuse in insertion position in a balanced manner.

What is claimed is:

1. A fuse assembly comprising:

a first fuse comprising,
- a first housing; and
- a pair of first terminals having a first pitch between first terminals and projecting from the first housing in a mounting direction, a second fuse comprising,
- a second housing; and
- a pair of second terminals having a second pitch between second terminals identical to the first pitch and provided on both sides of the second housing a mounting component mated with the first fuse or the second fuse, the mounting component comprising,
- mating terminals within the mounting component for electrically conducting with the first terminals or second terminals;
- a first stopper configured to position the first fuse relative to the mounting component for electrically connecting the first terminals and the mating terminals with each other; and
- a second stopper configured to position the second fuse relative to the mounting component for electrically connecting the second terminals and the mating terminals with each other.

2. The fuse assembly according to claim 1, wherein the first stopper is positioned in front of ends of the mating terminals, and wherein the second stopper is positioned back from the ends of the mating terminals.

3. The fuse assembly according to claim 1, wherein the first housing comprises a pair of first tapers, wherein the mounting component comprises inner walls opposite to each other, and wherein the first stopper comprises a pair of stopper members with upper ends having a pair of second tapers, the pair of second tapers is configured to abut against the pair of first tapers.

4. The fuse assembly according to claim 1, wherein the second stopper comprises a bottom wall within the mounting component for abutting a lower end of the second housing against the bottom wall.

5. A fuse assembly comprising:

a first fuse comprising,
- a first housing; and
- a first terminal projecting from the first housing;

a second fuse comprising,
- a second housing; and
- a second terminal flush with the second housing or positioned back from the second housing;

a mounting component configured to mate with the first fuse or the second fuse, the mounting component comprising, a mating terminal for electrically conducting with the first terminal or the second terminal; and a positioning mechanism for positioning the first fuse or the second fuse to the mounting component, the positioning mechanism comprising, a first stopper mounted to the mounting component for abutting against the first housing, thus allowing electrical conduction between the first terminal and the mating terminal; and a second stopper mounted to the mounting component for abutting against the second housing, thus allowing electrical conduction between the second terminal and the mating terminal.

6. The fuse assembly according to claim 5, wherein the first stopper extends beyond the mating terminal.

7. The fuse assembly according to claim 5, wherein the second stopper is positioned back from the mating terminal.

8. The fuse assembly according to claim 5, wherein the first stopper comprises a taper for engaging with the first housing.

* * * * *

UNITED STATES PATENT AND TRADEMARK OFFICE

CERTIFICATE OF CORRECTION

PATENT NO. : 6,781,503 B1
DATED : August 24, 2004
INVENTOR(S) : Katsuhiro Kubota It is certified that error appears in the above-identified patent and that said Letters Patent is hereby corrected as shown below:

Title page,
Item [57], ABSTRACT,
Line 5, "Includes" should read -- includes --.

Signed and Sealed this

First Day of February, 2005

JON W. DUDAS
*Director of the United States Patent and Trademark Office*